US007037015B1

(12) United States Patent
Witz et al.

(10) Patent No.: US 7,037,015 B1
(45) Date of Patent: May 2, 2006

(54) ROLLER BALL PEN FOR PIGMENTED INKS

(75) Inventors: Wolfgang Witz, Wake Forest, NC (US); Sean A. Ferrigan, Gramby, MA (US); Norman P. De Bastiani, South Hadley, MA (US)

(73) Assignee: Chartpak, Inc., Leeds, MA (US)

( * ) Notice: Subject to any disclaimer, the term of this patent is extended or adjusted under 35 U.S.C. 154(b) by 0 days.

(21) Appl. No.: 11/191,427

(22) Filed: Jul. 27, 2005

(51) Int. Cl.
*A46B 11/00* (2006.01)
*B43K 7/00* (2006.01)
*B43K 7/02* (2006.01)

(52) U.S. Cl. ..... 401/4; 401/209; 401/217

(58) Field of Classification Search ..... 401/4, 401/209, 214, 217, 223–224, 225
See application file for complete search history.

(56) References Cited

U.S. PATENT DOCUMENTS 3,738,760 A 6/1973 Madelra
3,951,555 A 4/1976 Wittnebert et al.
4,290,706 A 9/1981 Wandl
4,753,546 A 6/1988 Witz et al.
5,073,058 A 12/1991 Fukuoka et al.
5,277,510 A * 1/1994 Okamoto et al. ..... 401/214
5,420,615 A 5/1995 Witz et al.
5,688,061 A 11/1997 Aoki
6,536,969 B1 3/2003 Nishitani
6,755,587 B1 * 6/2004 Fukushima ..... 401/214

* cited by examiner

*Primary Examiner*—David J. Walczak
(74) *Attorney, Agent, or Firm*—Schweitzer Cornman Gross & Bondell LLP

(57) ABSTRACT

A free ink roller ball pen for dispensing low viscosity inks containing pigments that are prone to sedimentation. The instrument contains an ink reservoir chamber, a nib chamber provided with a roller ball socket assembly, a pressure equalization overflow chamber for the low viscosity ink, and a special agitation system for the ink reservoir and nib chamber. The agitation system comprises a weight, with a cross section smaller than the interior of the nib chamber, connected to a wire having a diameter smaller than the back inner diameter of the ball socket assembly. The length of the weight and its confinement are selected to provide for a predetermined stroke, on shaking the pen, that sweeps out the internal space of the nib and also the back of the roller ball assembly, to re-disperse any pigment that has precipitated.

20 Claims, 7 Drawing Sheets

ROLLER BALL PEN FOR PIGMENTED INKS

FIELD OF THE INVENTION

The invention relates to pens for applying pigmented ink, and more particularly to a novel and improved roller ball-type pen suitable for the application of low viscosity, highly pigmented inks.

BACKGROUND OF THE INVENTION

There is a significant demand for the use of inks with exotic and unusual colors, in order to achieve special effects on a variety of writing surfaces. Such special effects often require the incorporation of large and/or dense pigment particles in the writing inks. The use of such pigments, however, creates problems with respect to precipitation of the pigment out of the low viscosity ink carrier, especially after periods of nonuse of the writing instrument.

One of the known devices for applying pigmented inks is the use of squeeze tube cartridge, which is filled with a high viscosity ink. The ink is sufficiently viscous to minimize precipitation of the pigment particles. These instruments are difficult to use, however, and offer little control over the width, and even the precise location, of the intended line. The high viscosity of the ink medium is also disadvantageous in that its penetration into the writing surface is very limited, so that the desired optical effects are not fully achieved. In addition, the resulting heavy lines of high viscosity ink take an excessive amount of time to dry and are subject to smudging. An example of a pen employing a squeezable cartridge tube is the Aoki U.S. Pat. No. 5,688,061, which employs a main body that is flexible, so that the ink can be extruded by squeezing with the fingers. Even so, the pen is provided with a spring-based agitating system to stir the ink and promote dispersion of the pigment.

Conventional ballpoint pens utilize a roller ball in connection with a relatively high viscosity ink which can hold pigment materials in suspension. The ballpoint pen relies upon pressure of the atmosphere to maintain the high viscosity ink in contact with the dispensing ball. When the ball is rotated, a shearing action of the ball surface against the ink body reduces the viscosity of the ink contacting the ball sufficiently to allow the ink to be transferred by the ball from the back of the ball socket to the intended writing surface. The relatively high viscosity of the ink, however, limits its penetration into the paper. Smudging is also a problem with the higher viscosity inks of ballpoint pens. Even with some ballpoint pens, it may be desirable to provide an agitating arrangement to redisperse any coagulated pigment. An example of such is the Nishitani U.S. Pat. No. 6,536,969.

So-called gel pens utilize somewhat lower viscosity ink than the standard ballpoint pens, and thus are an improvement over such ballpoint pens. However, the ink utilized in gel pens is still of relatively high viscosity, so as not to leak from the reservoir or the tip of the pen. The "gel" ink is applied in a manner similar to the ballpoint pen, by the rotating ball subjecting the ink to a shear force to reduce its viscosity as it is being transferred by the ball from the ink supply to the writing surface. While the gel pen is a marginal improvement over the ballpoint pen, it suffers some of the same disadvantages of limited penetration of the ink into the writing surface and some degree of smudging of the applied ink.

Free ink roller ball pens, utilizing low viscosity inks, are in general well known and have been manufactured and sold for many years. Representative such roller ball pens, as made for example by Chartpak, Inc., and also by Pentel, Pilot and Mitsubishi, provide a chamber for low viscosity, liquid ink communicating with a roller ball tip assembly. The ink reservoir has a confined air space above the ink, and the reservoir is maintained in communication with the atmosphere through a pressure equalization chamber, typically a single path or multiple path labyrinthine passageway, such as an injection molded lamella of wetable plastic. This allows air to enter the reservoir as the ink is consumed, and also provides for expansion and contraction of the reservoir air in response to variations in the temperature and/or ambient pressure.

Conventional free ink roller ball pens typically utilize a stainless or tungsten carbide roller balls, manufactured to very tight tolerances and closely received in suitable sockets. Typically, a fibrous feed rod extends up into the ink reservoir, providing a capillary system to maintain the ink supply at the back of the roller socket. It is well known that conventional free ink roller ball pens are unsuitable for use in connection with inks containing pigment that is inherently unstable in the low viscosity ink vehicle. The specialty pigments, desired to achieve effects such as metallic appearance, pearlization, pastel colors, luminescence, thermochromic effects and the like, tend to be too large and/or too dense to be retained in suspension in the low viscosity inks over any significant time period, as when the pen is stored between uses.

SUMMARY OF THE INVENTION

The present invention is directed to a new and improved roller ball pen, utilizing a low viscosity, free flowing ink medium. The new pen is constructed to enable the use of such low viscosity, free flowing inks carrying pigments that are inherently unstable in the fluid medium and may settle out during periods of nonuse of the pen. A novel agitator arrangement is provided, which can be activated when the pen is to be used, such that any precipitated pigment is redispersed throughout the ink supply, and the flow passages to the roller ball are cleared of sedimented pigment particles.

In a preferred embodiment of the invention, the agitator arrangement includes a reciprocating weight element which is movably confined within the nib structure of the pen, for limiting axial motion. The weight element carries a forwardly projecting wire at its front end, which projects into the roller ball socket assembly. When the pen is shaken in an axial direction, the weight and the wire mounted thereon reciprocate through a limited axial travel in a manner to effectively agitate and redisperse any pigment that has sedimented from the low viscosity ink vehicle.

In one alternative form of the invention, the wire element carried by the reciprocating weight is arranged such that, in its forwardmost position, the end of the wire is extremely close to or in contact with the roller ball at the end of the ball socket assembly. The arrangement is such that, as the wire and weight reciprocate within the nib structure, the wire positively displaces any sedimented pigment that is behind the roller ball, redispersing the pigment and enabling a free flow of low viscosity ink through the capillary passages leading to the roller ball, for application to a writing surface. The weight itself, reciprocating within a confined internal space in the nib structure, serves to sweep the internal space of the nib and to agitate and redisperse pigment within that area such that, with a few shakes of the pen, sedimented ink is effectively redispersed and the pen is fully reactivated for normal writing to apply the pigmented ink.

In another alternative form of the invention, a wire, carried at the front of a reciprocating weight, is permitted to travel up to, but not enter, the final capillary passage to the back of the roller ball. The arrangement is such that, with a vigorous shaking of the pen, a shockwave is created within the final capillary passage leading to the roller ball, to disturb and redisperse any sedimented pigment present therein. This action takes place in conjunction with the action of the reciprocating weight within a confined passage of the nib structure, to effectively agitate the ink supply throughout the nib structure and thoroughly redisperse the pigments therein.

In any of its forms, the pen of the invention may advantageously include one or more free weights, such as metal spheres, within the main ink reservoir, so that the ink supply within the reservoir itself is agitated when a user shakes the pen in the manner contemplated.

For a more complete understanding of the above and other features and advantages of the invention, reference should be made to the following detailed description of preferred embodiments of the invention, and to the accompanying drawings.

DESCRIPTION OF PREFERRED EMBODIMENTS

Figure 1:
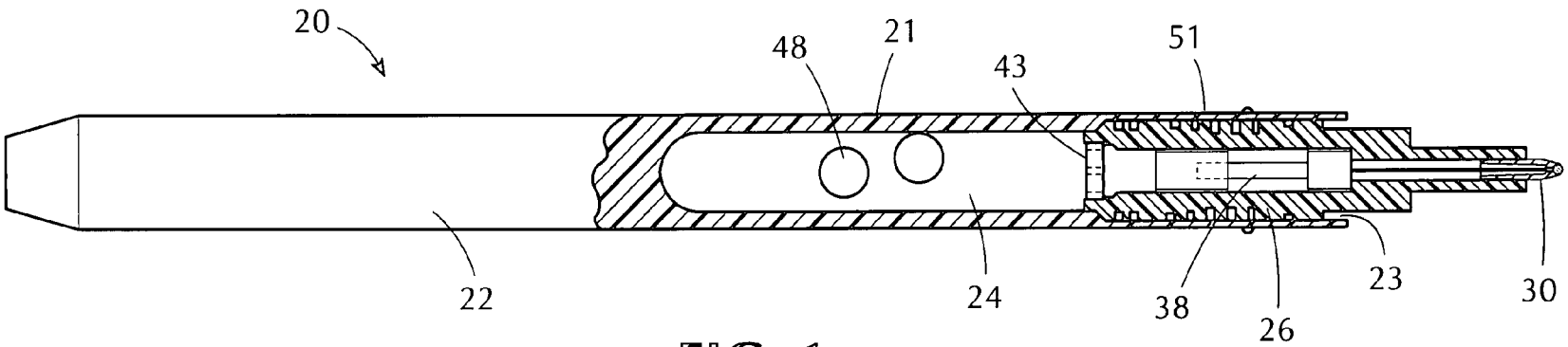
FIG. 1 is an elevational view, partly in section, showing features of one preferred embodiment of the invention.

Referring now to the drawings, the reference numeral 20 designates generally a roller ball pen according to the invention, for use particularly in applying pigmented inks to a writing surface. The pen includes an elongated pen body 21, typically of molded plastic construction, which is closed at one end 22 and formed at the opposite end with a first cavity 23, for the reception of a nib structure to be described, and a second cavity 24 forming a reservoir for an ink supply and a confined air space above the ink. In the illustrated form of the invention, the reservoir cavity 24 is formed by the walls of the pen body. However, it is contemplated that the ink supply may be contained in a replaceable cartridge (not shown) which is removably received within the cavity 24. The use of such removable cartridges is well known in the art and does not form part of this invention.

Figure 2:
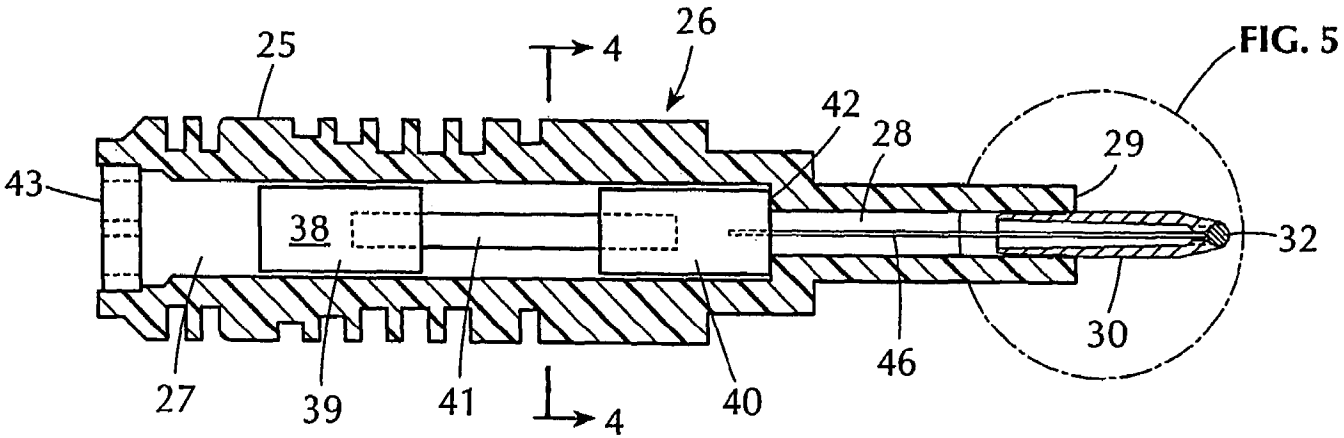
FIG. 2 is an enlarged cross sectional view of a nib structure and reciprocating weight arrangement incorporated in the pen of FIG. 1.
Figure 4:
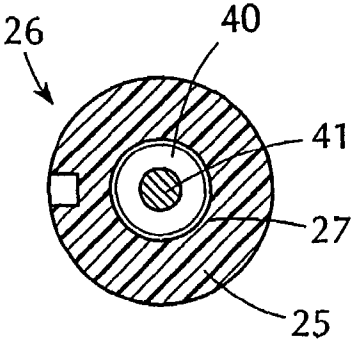
FIG. 4 is a cross sectional view as taken generally on line 4—4 of FIG. 2.
Figure 3:
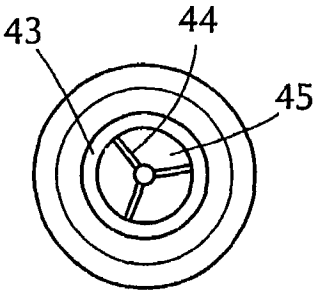
FIG. 3 is an end elevational view of the nib structure of FIG. 2.

The forward cavity 23 of the pen body is of a size to snugly receive the generally cylindrically shaped body portion 25 of a nib structure 26 (FIG. 2). The nib structure 26 is slightly tapered to seat tightly within the cavity 23 and serves as a closure for the ink reservoir cavity 24. The nib structure 26 is configured to form an upper cylindrical cavity 27 and a lower cylindrical cavity 28, providing ink flow communication from the reservoir cavity 24 to the lower end extremity 29 of the nib structure.

Figure 5:
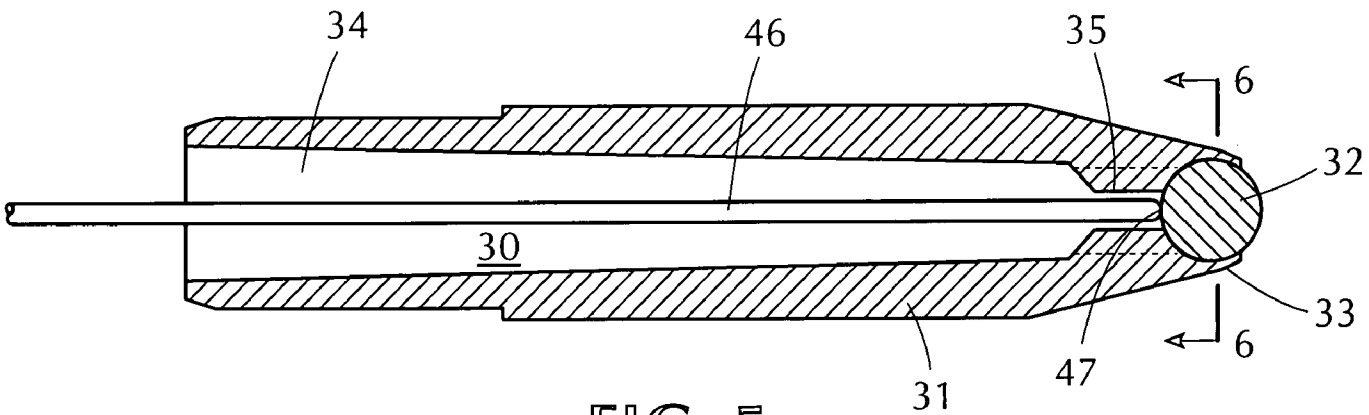
FIG. 5 is an enlarged cross sectional view of a ball socket assembly incorporated in the pen of FIG. 1, illustrating a portion of a reciprocating wire element that extends, in its forwardmost position, into contact or near contact with the back of a roller ball.
Figure 6:
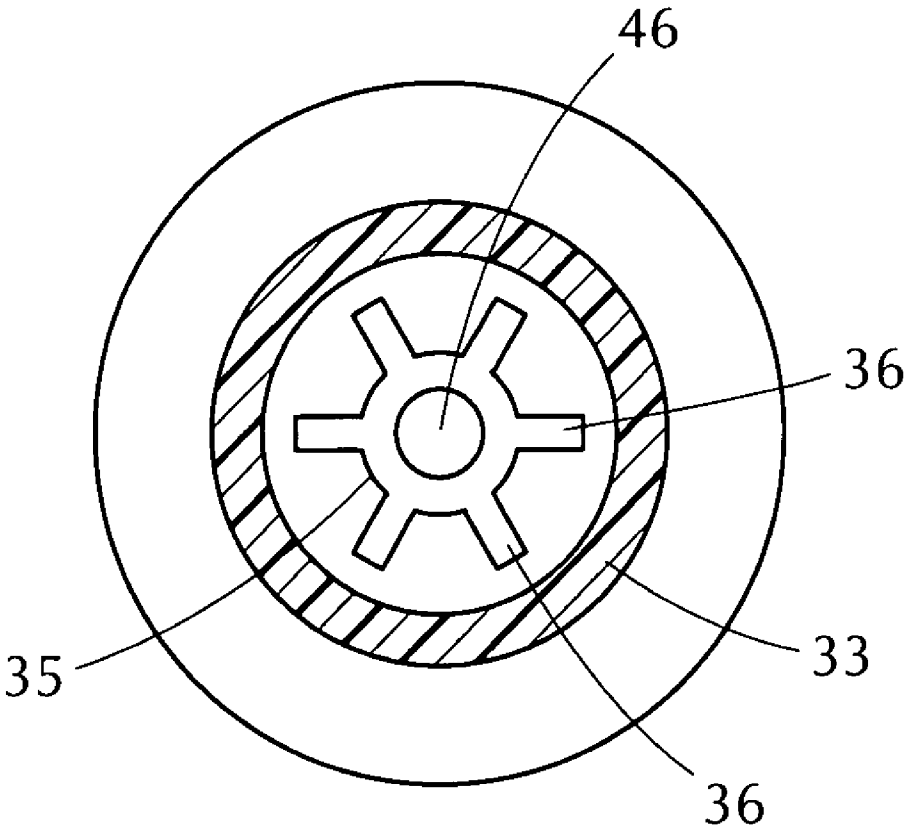
FIG. 6 is a cross sectional view as taken generally on line 6—6 of FIG. 5, with the roller ball removed from the socket assembly.

A roller ball tip assembly 30, comprising a socket 31 and roller ball 32 (FIG. 5) is tightly received within the lower cylindrical cavity 28 of the nib structure and provides the mechanism by which ink is transferred from the cavity 28 on to a writing surface (not shown). The tip assembly 30 is a product which is available commercially from such sources as Premec SA, Lugano, Switzerland. These tip assemblies are designed to function exclusively with low viscosity liquid inks. A typical such tip structure may include a roller ball 32 seated in a close-fitting socket 33. The socket engages the roller ball over a diametral region thereof, such that the ball is retained in a generally fixed location, but is able to roll in any direction. The ball 32 typically may be formed of materials such as tungsten carbide, ceramic, or synthetic sapphire, for example, which is fitted to very tight tolerances in the socket 33. The diameter of the roller ball 32 may be varied as appropriate to achieve line width in a range of about 0.008 inch to about 0.080. A typical roller ball diameter is about 0.040 inch.

The upper portion of the tip assembly 30 comprises a narrow ink-receiving recess 34 of relatively small diameter (e.g., 0.045 inch) which connects at its lower extremity with a narrow capillary flow passage 35 leading to the back of the roller ball 32. The capillary flow passage 35 communicates a short distance above the roller ball 32 with a plurality of ink distributing passages 36 that allow the ink to flow to various portions of the surface of the roller ball as the latter rotates against a writing surface. The structure of the roller ball tip assembly as thus described is previously known and is not by itself part of the present invention.

Pursuant to one aspect of the invention, the upper chamber 27 of the nib structure 26 receives an elongated weight element 38, which is closely received within the cavity 27 and is somewhat shorter than the overall length of the cavity 27. In the form of the invention illustrated in FIGS. 1–7, the weight 38 comprises upper and lower end caps 39, 40, preferably formed of plastic material, and a central portion 41 formed of a heavy material, preferably stainless steel or the like. The weight of the components 39–41 is such that the weight 38 as a whole is negatively buoyant in the low viscosity ink fluid (i.e. has a greater density than the displaced fluid).

A shoulder 42, formed where the larger upper cavity 27 joins with the smaller diameter lower cavity 28, is positioned to engage the front face of the lower end cap 40 and thus to serve as a limit stop for downward/forward movement of the weight within the cavity 27. An upper stop member 43 is inserted into the upper end of the cavity 27 and includes radially disposed web elements 44 which serve to engage the upper end cap 39 of the weight element, and thus function as an upper limit stop to movements of the weight 38 within the cavity 27. Open spaces 45 between the radial webs 44 enable a free flow of ink into and from the cavity 27.

Pursuant to another aspect of the invention, a long, slender agitating wire 46 is anchored at one end in the front end cap 40 of the reciprocating weight element 38 and extends downward/forward to the lower end of the roller ball tip 30. In this first illustrated form of the invention, the agitating wire 46, in its forwardmost limit position, as determined by engagement of the front end cap 40 with the shoulder 42, is positioned such that the forwardmost tip 47 of the wire is extremely close to the back surface of the roller ball 32, and preferably is in light, touching contact therewith. The wire 46 has a diameter which is somewhat less than the diameter of the capillary flow passage 35 leading to the back of the roller ball. For example, in a preferred embodiment of the invention, the agitating wire 46 may have a diameter of approximately 0.010 inch, while the diameter of the capillary flow passage 35 may be around 0.020 inch. Accordingly, when the wire 46 is positioned within the capillary flow passage 35, there is sufficient clearance space available to accommodate the flow of ink from the internal recess 34 of the tip assembly through the capillary flow passage 35 and the distribution passages 36 to the back surface of the roller ball 32.

In the embodiment of FIGS. 1–7, the reciprocating weight 38 is dimensioned to have a length somewhat less than the effective length of the cavity 27, between the shoulder 42 and the stop element 43 at the opposite end. In a preferred embodiment of the invention, the effective length of the weight element 38 is around 0.015 inch shorter than the effective length of the cavity 27, and preferably 0.015 inch to 0.030 inch shorter. Accordingly, when the assembled pen unit is shaken in an axial direction by the user, the weight 38 can reciprocate through a short stroke of the above-indicated dimensions within the cavity 27. As will be understood, when the weight element reciprocates to its upper/rearward position, with the end cap 38 abutting the stop element 43, the wire 46 is completely withdrawn from the capillary flow passage 35. When the weight element reciprocates in the opposite direction, the wire element 46 enters the capillary passage and extends into contact with or immediately proximity of the back surface of the roller ball 32. When the wire 46 enters and passes through the capillary flow passage 35, it not only stirs up and agitates the liquid therein, but will physically displace any sedimented pigment in the capillary passage and clear out the passage for a proper flow of ink to the back of the roller ball.

The axial reciprocating movements of the weight element 38 within the cavity 27 tend to scour the chamber and agitate the ink contained therein, in order to disperse pigments carried by the ink and to redisperse and distribute any pigments that may have settled out. The agitation of the ink supply by the main body of the weight element also thoroughly agitates ink contained in the lower chamber portion 28, as a result of the scouring action of the weight in the cavity 27.

In the form of the invention illustrated in FIGS. 1–7, the end caps 39, 40 of the weight element 38 advantageously have a clearance space with the internal walls of the cavity 27 of about 0.010 inch to about 0.100 inch, and preferably in the range of 0.010 inch to 0.030 inch. In the illustrated embodiments, the end caps 39, 40 and the cavity 27 are of cylindrical configuration. However, the cross sectional configuration of the weight element and of the cavity 27 may be formed with ridges and channels, if desired, to further promote fluid flow and pigment redispersion when the weight element is reciprocated. In practice, only a few shakes of the pen are sufficient to thoroughly agitate the ink supply and disperse its contained pigments.

Preferably and advantageously, the ink reservoir cavity 24, provided in the pen body 20 above the nib structure, is provided with one or more agitating elements 48, preferably in the form of small (e.g., ⅛th –3⁄16th inch diameter) stainless steel balls, which are freely movable within the cavity 24. When the shaking action is imparted to the weight element 38, to clear the chambers and passages of the nib structure, the agitator elements 48 move randomly about the cavity 24 and thoroughly agitate and stir the ink supply retained therein. Addtionally, when the pen is shaken, the agitating elements 48 will impact the upper end of the nib structure and serve in some measure to contribute to the agitation and pigment dispersion of the ink contained within the nib structure.

The roller ball pen of the invention is intended specifically for use with free bodies of low viscosity inks, which are far superior to gel inks and ballpoint pen inks for use in connection with pigmentation. In particular, the inks contemplated for use in the pen of the invention may range from around 3 to around 20 centipoise in viscosity, and preferably in the range of 3 to around 8 centipoise. These low viscosity inks are particularly desirable for decorative work with pigments, because the liquid vehicle for the pigment is quickly and substantially absorbed by the paper or other writing surface, so that the pigmentation is more visible and therefore more effective. When gels and higher viscosity inks are utilized, the ink vehicle does not absorb well into the writing surface and to some degree remains on top of the pigment particles reducing their optical effectiveness. The unabsorbed ink also remains a smudging problem, for at least a period of time. Some of the desired pigments are in the form of large particles which easily precipitate for that reason. Others (for example, titanium dioxide) are very dense and will tend to precipitate out of the low viscosity ink regardless of particle size. The highly effective agitating system of the present invention, however, makes it possible to effectively utilize the desired pigments in a low viscosity vehicle, such that the optical effects of the pigments can be optimally realized.

In the roller pen of the invention, provision is made for equalization of pressure between the ink reservoir cavity 24 and the atmosphere, so that as the low viscosity ink is consumed, it can be replaced in the reservoir by air, and also so that accommodation can be made for changes in pressure and/or temperature that may cause expansion or contraction of the air and ink in the reservoir. The provision for such equalization, which in itself is well known, involves the provision of a labyrinthine capillary system in the nib structure which accommodates the flow of air into the ink reservoir as needed to replace consumed ink, and also provides for the temporary storage of some of the ink, for pressure equalization.

Figure 7:
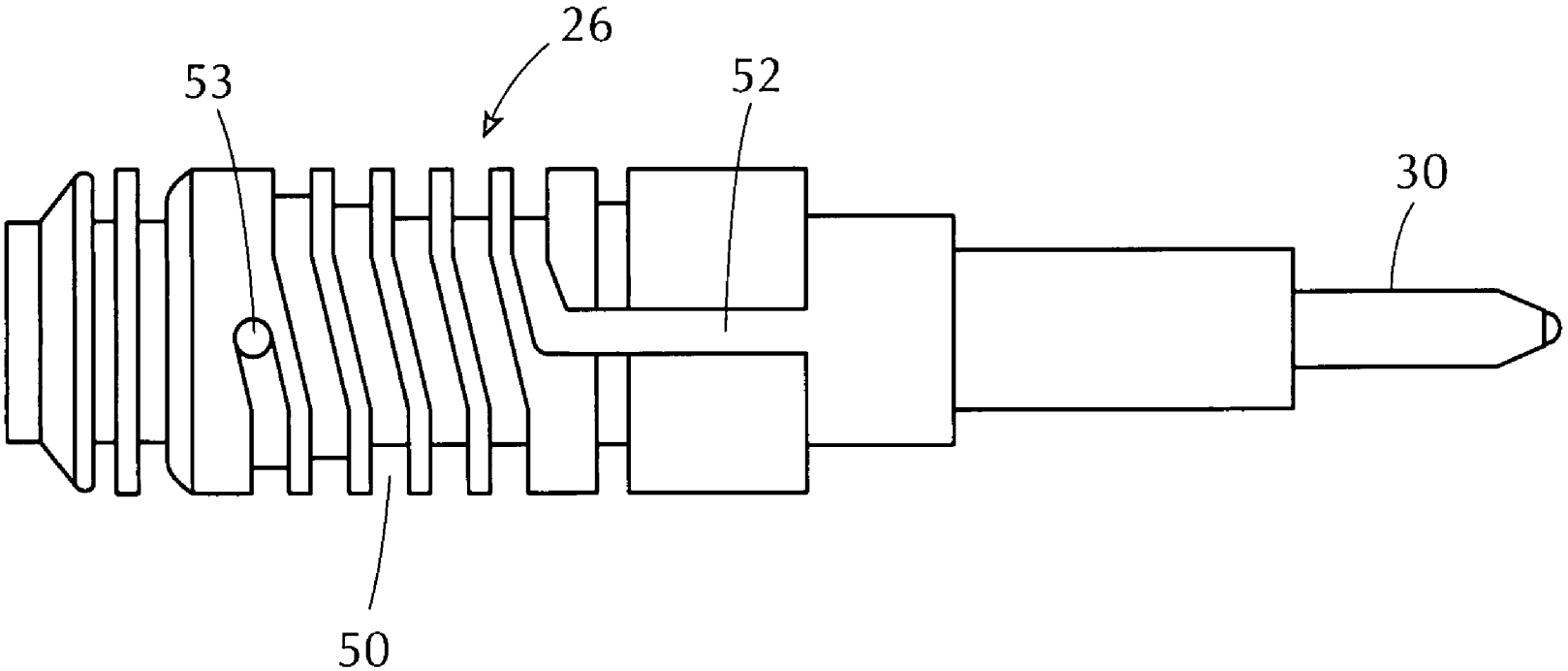
FIG. 7 is a side elevational view of the nib structure of FIG. 2, illustrating a form of capillary passage formed in the nib structure to enable communication between the ink reservoir and the atmosphere, to accommodate expansion and contraction of the ink and air in the ink reservoir, in response to temperature and pressure variations.

As shown in FIG. 7, the nib structure 26 is provided externally with a spiral capillary pathway 50 which is closed on the outside by a cylindrical wall 51 forming the lower end of the pen body. At its lower end, the spiral pathway terminates in an axially directed passage 52, which is open to the atmosphere at the lower end of the pen. At its upper end, the spiral pathway 50 communicates with a radial passage 53 extending inwardly, and communicating with an upper portion of the nib cavity 27. The arrangement is such that ink can flow into and out of the spiral capillary pathway 50 as necessary to respond to pressure/temperature changes within the pen, and air can enter the pen as necessary to replace ink as it is consumed from the reservoir. The spiral capillary pathway 50, in itself well known, is an advantageous form of capillary system to utilize in connection with pigmented inks.

Figure 9:
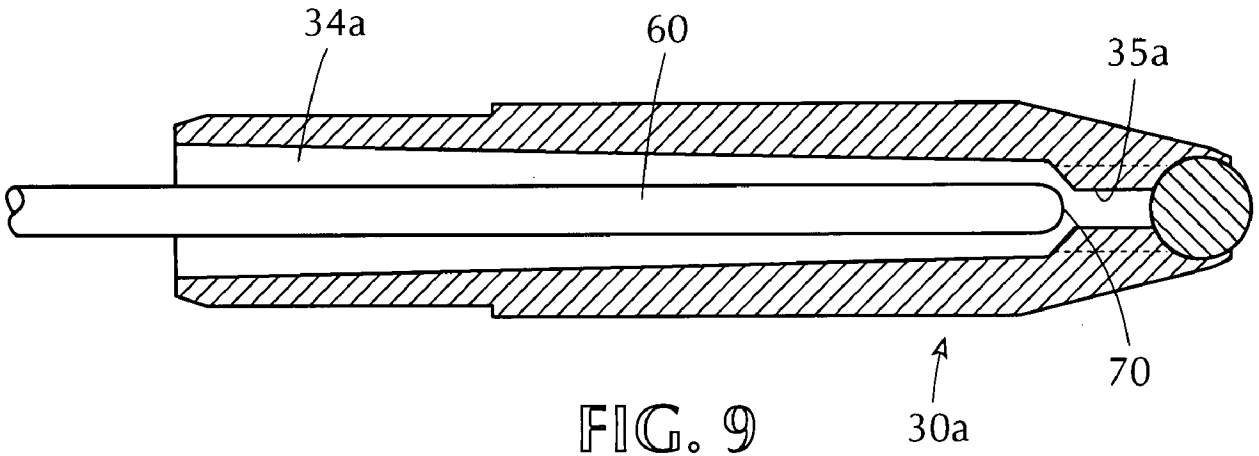
FIG. 9 is an enlarged, fragmentary cross sectional view of the ball socket assembly incorporated with the nib structure of FIG. 8.
Figure 8:
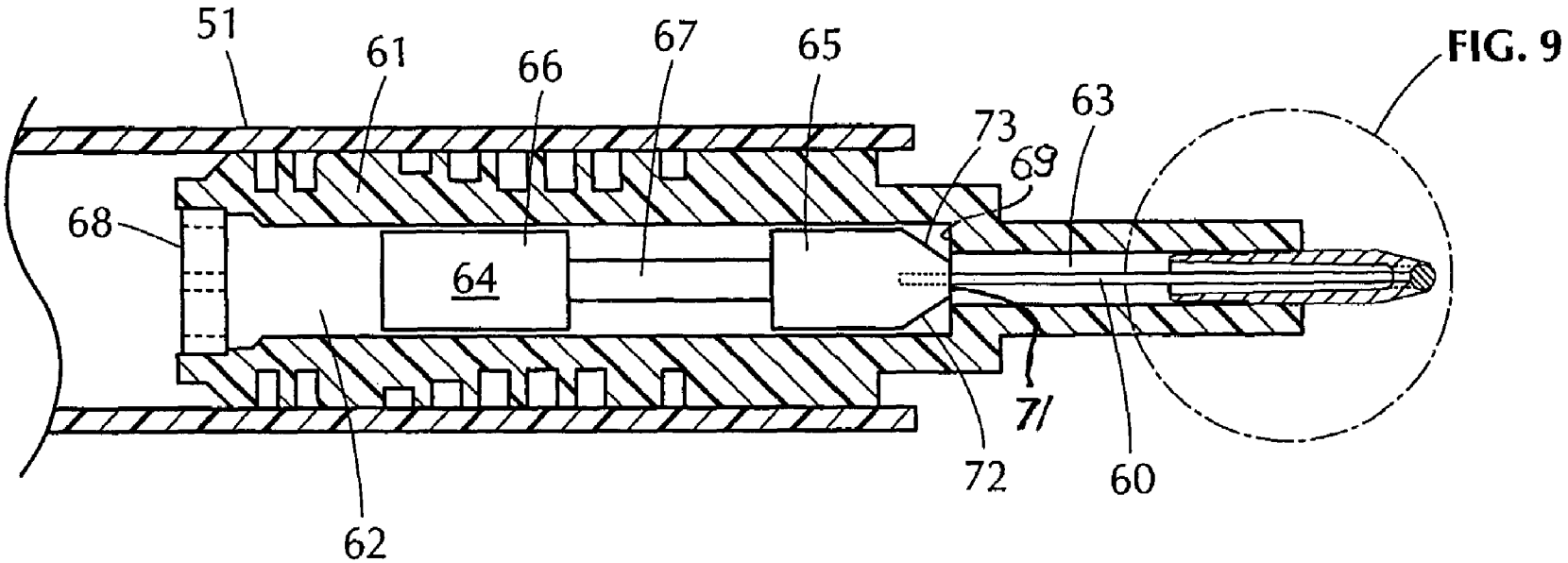
FIG. 8 is an enlarged, fragmentary cross sectional view showing a nib structure and an alternative form of agitating element associated therewith.

In a second preferred embodiment of the invention, shown in FIGS. 8 and 9, an agitating wire 60 is employed, which is considerably larger in diameter than the wire 46 of the embodiment of FIGS. 1–7. Thus, whereas the wire 46 (FIG. 2) may be about 0.010 inch diameter, small enough to easily enter and pass through the capillary flow passage 35 in the tip assembly 30, the wire 60, shown in FIGS. 8 and 9, may have a diameter on the order of 0.031 inch, somewhat larger than the capillary flow passage 35*a* in the writing tip assembly 30*a*.

The nib structure 61 shown in FIG. 8 is similar to that shown in FIG. 2 and comprises a molded plastic element provided with an upper cavity 62 communicating directly with a lower cavity 63 of somewhat smaller diameter, in which the tip assembly 30*a* is inserted and mounted. A reciprocating agitator weight 64, comprising plastic front and rear caps 65, 66 and a metal center portion 67, is arranged for a reciprocating movement of defined and limited stroke within the upper cavity 62. A stop element 68 at the upper end of the cavity 62 serves as an upper limit for the agitator weight 64, and a shoulder 69, formed at the juncture of the upper and lower cavities 62, 63, serves as a lower limit stop for the weight. The wire 60 is anchored in and projects forwardly from the front end cap 65 of the weight, as shown in FIG. 8.

In the illustration of FIG. 9, the wire 60 is shown in its forwardmost position, in which the forward tip 70 of the agitating wire 60 is spaced a short distance (e.g., less than 0.010 inch) away from the entrance to the capillary flow passage 35*a*. The forwardmost position of the wire 60 is determined by engagement of the front surface 71 of the agitator front portion 65 with the shoulder 69. Preferably, the front end cap 65 is formed with opposed flat tapered surfaces 72, 73 on opposite sides of the front surface 71 such that, when the front surface is abutted against the shoulder 69, there is clearance space to accommodate ink flow between the cavities 62, 63. Sufficient clearance is also provided between the wire tip 70 and the capillary flow passage 35*a* to accommodate the flow of ink from the internal recess 34*a* of the tip assembly 30*a* into the capillary flow passage 35*a* when the agitator weight 64 is in its forwardmost position.

In the embodiment of FIGS. 8 and 9, when the agitator weight 64 is reciprocated, the motion of the wire 60 within the recess 34*a* displaces ink within that recess and also creates a shockwave directed into the capillary flow passage 35*a* to agitate and disperse any sedimentation within that passage. Additionally, the agitator weight 64 is of a size and shape to provide a small clearance space with the side walls of the cavity 62 of about 0.010 inch to about 0.100 inch, and preferably in the range of 0.010 inch to 0.030 inch. The component elements 65–67 of the weight 64 have an overall length which is slightly shorter (e.g., 0.015 inch to 0.030 inch) than the length of the cavity 62 as defined by the stop element 68 and the shoulder 69. Thus, when the pen body is vigorously shaken, the weight 64 reciprocates through a defined distance, impacting the nib at both ends of its stroke, to thoroughly agitate the ink supply and redisperse any precipitated pigment.

Figure 10:
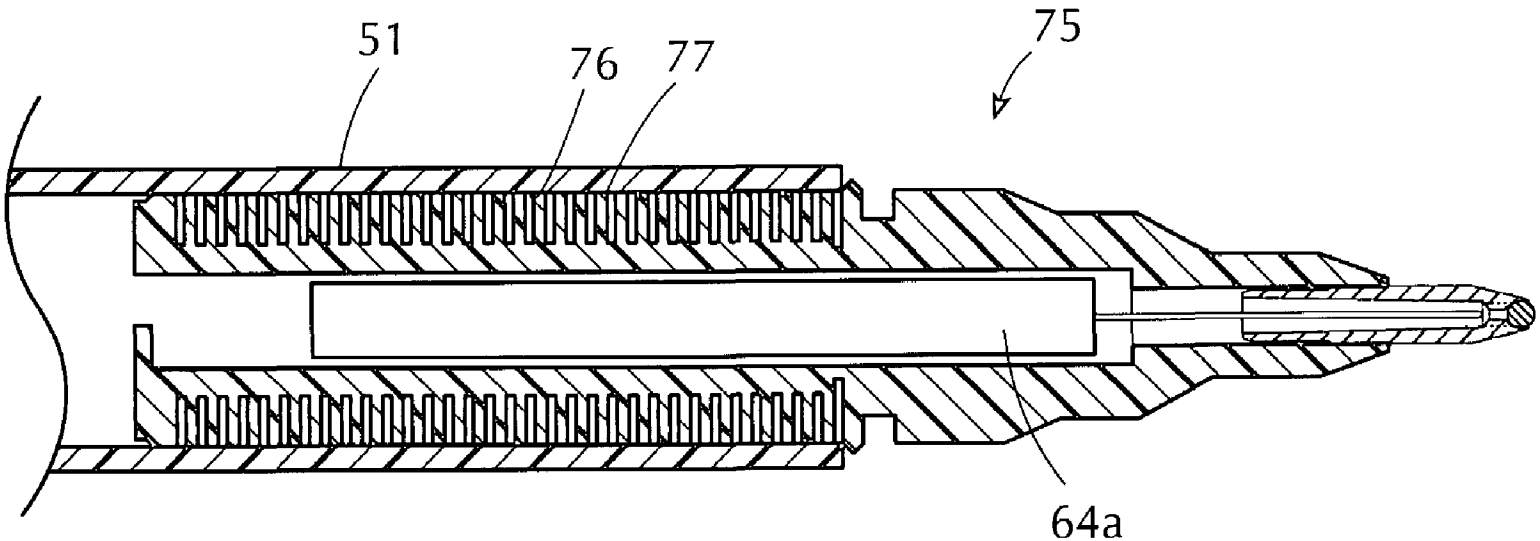
FIG. 10 is a fragmentary cross section of a further alternative form of the invention, utilizing a lamella-type nib structure.

The nib structure 75 shown in FIG. 10 optionally incorporates an equalization system different from that of the nib structure of FIG. 7, in that the capillary system provided for pressure equalization is not in the form of a continuous spiral but rather in the form of a series of closely spaced annular capillary spaces 76 separated by thin annular lamellae 77. The individual annular spaces 76 are connected by an axial capillary slot (not shown). This form of nib structure is well known, and is shown in more detail in, for example, U.S. Pat. No. 6,464,420. The structure of FIG. 10 can utilize an agitator arrangement 64*a* of either of the types heretofore described, or of other configuration suitable to provide a sweeping action within the nib cavities and redispersal of the ink pigments when the pen is shaken.

In any of the various forms of the invention, it will be understood that the ink supply may take the form of a separable ink cartridge arranged to be inserted into the pen body above nib structure and arranged to communicate with the nib structure when the pen is assembled by the user. Such cartridge arrangements are well known in the art. In the present instance, it may be advantageous to provide the cartridges with agitating elements such as the balls 48 (FIG. 1) to facilitate agitation of the ink supply in the cartridge.

The pen of the present invention represents a significant advance in the art, in that it provides an effective and practical instrument for the delivery of highly pigmented inks using a roller ball pen and a low viscosity ink medium. While pigmented inks are widely used, it is customary to utilize such inks in other than roller ball pens. With standard ballpoint pens and gel pens, for example, pigmented inks can be effectively employed because of the high viscosity of the ink vehicle effectively maintains the pigments in suspension. However, because of the relatively high viscosity of such inks, the ink from these pens is not easily absorbed in the writing paper. The higher viscosity inks tend to largely remain on the surface, partially obscuring the pigments and also creating a potential for smudging. Utilizing the roller ball pen, with low viscosity inks according to the present invention, enables the low viscosity inks to be readily absorbed into the writing paper such that the pigment particles are more visible and optically more effective for their intended purposes. The use of a roller ball instrument with low viscosity inks also enables the writer to have optimum control over the form and width of the line.

The combination of elements incorporated in the pens of the invention enable the user, in a few shakes of the pen, to redisperse any settled pigments, and also to clear the capillary passages leading to the back of the roller ball. This makes it quite feasible to utilize pigments of large particle size and/or density in conjunction with low viscosity inks, for superior optical results.

It should be understood, of course, that the specific forms of the invention herein illustrated and described are intended to be representative only, as certain changes may be made therein without departing from the clear teachings of the disclosure. Accordingly, reference should be made to the following appended claims.

The invention claimed is:

1. A writing pen for use with free-flowing, low viscosity, pigmented inks subject to pigment sedimentation, which comprises (a) a pen body including an upper portion for retaining a supply of low viscosity, pigmented ink, (b) a supply of low viscosity, pigmented ink contained in said upper portion, (c) means forming a confined air space above said ink, (d) a nib structure joined with a lower portion of said pen body and having internal passage means communicating with said upper portion for receiving ink from said supply thereof, (e) a roller ball assembly at a lower end of said nib structure and comprising a roller ball and a socket retaining said roller ball and provided with a capillary flow passage to accommodate the flow of ink to a back portion of said roller ball, (f) a capillary system providing communicating between said supply of ink and the atmosphere to accommodate expansion and contraction of said ink and of air in said air space resulting from changes in pressure and temperature, and (g) an axially movable agitating element contained at least in part within the internal passage means of said nib structure and immersed in said ink, (h) said agitating element being reciprocally movable within said nib structure by shaking of said pen and being shaped and contoured to sweep said internal passage and to re-disperse pigment sedimented therein to enable the free flow of pigmented ink to said roller ball, (i) said agitating element including a portion associated with said capillary flow passage and operative to clear said capillary flow passage when said agitating element is reciprocated.

2. A writing pen according to claim 1, wherein, (a) the internal passage means of said nib structure comprises an elongated flow passage extending from an upper end of said nib structure toward said roller ball assembly and said capillary flow passage extending from a lower end of said flow passage to the back side of said roller ball, and (b) said agitating element comprises a narrow, straight wire portion cooperable with said capillary flow passage and a weight element mounting said wire portion, (c) said weight element being guided and confined by said internal passage means.

3. A writing pen according to claim 2, wherein (a) said wire portion has a smaller diameter than and is receivable within said capillary flow passage.

4. A writing pen according to claim 3, wherein (a) the weight element of said agitating element cooperates with said nib structure to define a forward limit position of said agitating element during reciprocating movements thereof, and (b) said wire portion extends forward from said weight element a distance to be in light contact with or spaced only slightly from said roller ball when said weight element is in said forward limit position.

5. A writing pen according to claim 2, wherein (a) said weight element has a larger diameter then said capillary flow passage, (b) the weight element of said agitating element cooperates with said nib structure to define a forward limit position of said agitating element during reciprocating movements thereof, and (c) said wire portion extends forward from said weight element to a position close to but spaced from an upstream end of said capillary flow passage.

6. A writing pen according to claim 5, wherein (a) said wire portion extends to a forward limit position in which the forward extremity of said wire portion is sufficiently close to the upstream end of said capillary flow passage to send shock waves through the ink in said capillary flow passage during reciprocating movements of said agitating element in order to disturb and disperse sedimented pigment particles in said capillary flow passage.

7. A writing pen according to claim 1, wherein (a) said agitating element comprises a weight element and a wire portion extending forward from said weight element, (b) the internal passage means of said nib structure comprises an upper cavity of a size and shape to axially movably receive said weight element and a lower cavity of a size and shape to form an abutment shoulder to engage and function as a forward limit stop for said weight element, (c) said lower cavity communicating between said upper cavity and said capillary flow passage.

8. A writing pen according to claim 7, wherein (a) said weight element and said abutment shoulder are shaped to provide a communicating passage for the flow of ink from said upper cavity to said lower cavity when said weight element is positioned against said abutment shoulder.

9. A writing pen according to claim 8, wherein (a) a forward end of said weight element is formed with tapered surfaces on opposite sides thereof to form said communicating passage.

10. A writing pen for use with free-flowing, pigmented inks subject to pigment sedimentation, which comprises (a) a pen body having an open lower end for reception of a nib structure and an upper portion defining a reservoir cavity, (b) a supply of free-flowing, low viscosity, pigmented ink in said reservoir cavity, and subject to sedimentation of pigment during periods of non-use, (c) a nib structure received in the lower open end of said pen body, (d) said nib structure having an internal cavity communicating with said reservoir cavity and a roller ball tip assembly mounted at the lower end of said nib structure and communicating with said internal cavity, (e) said nib structure including an external capillary system providing communication between said reservoir cavity and the atmosphere, (f) an agitating element confined within said internal cavity and adapted for confined axial reciprocating movement therein upon reciprocation of said pen body, (g) said agitating element including a weight element of a size and shape to be closely received within at least a portion of said internal cavity to sweep and agitate the ink within said cavity portion when said agitating element is reciprocated within said cavity portion.

11. A writing pen according to claim 10, wherein (a) said roller ball tip assembly includes a capillary flow passage communicating with said internal cavity and leading to a back of a roller ball element carried by a forward end of said tip assembly, (b) said agitating element including a first portion comprising a weight element of a size and shape for confined axial reciprocating movement in said internal cavity and a second portion extending forward of said weight element and toward said capillary flow passage for dispersing sediment in said capillary flow passage.

12. A writing pen according to claim 11, wherein (a) the second portion of said agitating element comprises a wire-like element extending toward and at least close to an upper end of said capillary flow passage when said agitating element is in a forward limit position of said confined axial reciprocating movement.

13. A writing pen according to claim 12, wherein (a) said wire-like element has a diameter less than a diameter of said capillary flow passage and has a length to extend into said capillary flow passage during reciprocating movements of said agitating element.

14. A writing pen according to claim 13, wherein (a) an end extremity of said wire-like element is positioned in light contact with said roller ball element when said agitating element is in a forward-most limit position in its reciprocating movements.

15. A writing pen according to claim 13, wherein (a) an end extremity of said wire-like element is positioned a short distance away from said roller ball element when said agitating element is in a forward-most limit position in its reciprocating movements.

16. A writing pen according to claim 12, wherein (a) said wire-like element has a diameter greater than a diameter of said capillary flow passage and has a length to extend close to, but not into, an upper end of said capillary passage during reciprocating movements of said agitating element.

17. A writing pen according to claim 10, wherein (a) the external capillary system of said nib structure comprises a single path, spirally configured passage.

18. A writing pen according to claim 10, wherein (a) the external capillary system of said nib structure comprises multiple, closely spaced lamellae joined by an axially extending capillary connecting passage.

19. A writing pen according to claim 10, wherein (a) said reservoir cavity in said pen body is arranged to directly confine a body of ink and to provide an air space above said ink.

20. A writing pen according to claim 10, wherein (a) said ink has a viscosity of less than 20 centipoise.

* * * * *